US011626073B2

(12) United States Patent
Kwon

(10) Patent No.: US 11,626,073 B2
(45) Date of Patent: Apr. 11, 2023

(54) DISPLAY DEVICE AND AFTERIMAGE COMPENSATION METHOD THEREOF

(71) Applicant: LG ELECTRONICS INC., Seoul (KR)

(72) Inventor: Young Do Kwon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/753,876

(22) PCT Filed: Sep. 24, 2019

(86) PCT No.: PCT/KR2019/012379
§ 371 (c)(1),
(2) Date: Mar. 16, 2022

(87) PCT Pub. No.: WO2021/060572
PCT Pub. Date: Apr. 1, 2021

(65) Prior Publication Data

US 2022/0366853 A1 Nov. 17, 2022

(51) Int. Cl.
*G09G 3/3258* (2016.01)

(52) U.S. Cl.
CPC ... *G09G 3/3258* (2013.01); *G09G 2320/0257* (2013.01); *G09G 2320/045* (2013.01); *G09G 2320/046* (2013.01); *G09G 2340/16* (2013.01)

(58) Field of Classification Search
CPC ..... G09G 3/3258; G09G 2320/0257; G09G 2320/045; G09G 2320/046; G09G 2340/16
USPC ..... 345/204
See application file for complete search history.

(56) References Cited

U.S. PATENT DOCUMENTS

| | | | | |
|---|---|---|---|---|
| 9,418,591 | B2 * | 8/2016 | Kim | G09G 3/3225 |
| 10,762,824 | B2 * | 9/2020 | Chung | G09G 3/3275 |
| 11,114,018 | B2 * | 9/2021 | Jo | G09G 3/2007 |
| 2008/0068305 | A1 * | 3/2008 | Tada | G09G 3/3233 345/77 |
| 2020/0152154 | A1 * | 5/2020 | Chu | G09G 3/2003 |
| 2022/0198997 | A1 * | 6/2022 | Kim | G09G 5/377 |

* cited by examiner

*Primary Examiner* — Tom V Sheng
(74) *Attorney, Agent, or Firm* — Lee, Hong, Degerman, Kang & Waimey PC

(57) ABSTRACT

A display device and an afterimage compensation method thereof are proposed. The display device and the afterimage compensation method thereof capture an input image frame at a predetermined period, detect an edge area in the captured image frame, detect an afterimage compensation area on the basis of the cumulative count detected as the edge area for each pixel, and perform individual afterimage compensation only on a pixel whose cumulative count detected as the afterimage compensation area is greater than or equal to a predetermined threshold value. Accordingly, the afterimage compensation time may be shortened by individually performing the afterimage compensation according to a condition of each pixel.

20 Claims, 6 Drawing Sheets

FIG. 4

| | | | | | | | | |
|---|---|---|---|---|---|---|---|---|
| 5 | 5 | 5 | 5 | 5 | 5 | 5 | 5 | 5 |
| 5 | 5 | 5 | 5 | 5 | 5 | 5 | 5 | 5 |
| 5 | 5 | 5 | 5 | 5 | 5 | 5 | 5 | 5 |
| 5 | 5 | 5 | 5 | 5 | 5 | 5 | 5 | 5 |
| 5 | 5 | 5 | 5 | 5 | 5 | 5 | 5 | 5 |
| 5 | 5 | 5 | 5 | 5 | 5 | 5 | 5 | 5 |
| 5 | 5 | 5 | 5 | 5 | 5 | 5 | 5 | 5 |
| 5 | 5 | 5 | 5 | 5 | 5 | 5 | 5 | 5 |
| 5 | 5 | 5 | 5 | 5 | 5 | 5 | 5 | 5 |

(a) Vth initial value

| | | | | | | | | |
|---|---|---|---|---|---|---|---|---|
| 8 | 8 | 6 | 6 | 6 | 6 | 6 | 6 | 6 |
| 6 | 8 | 8 | 6 | 6 | 6 | 6 | 6 | 6 |
| 6 | 6 | 8 | 8 | 6 | 6 | 6 | 6 | 6 |
| 6 | 6 | 6 | 8 | 8 | 6 | 6 | 6 | 6 |
| 6 | 6 | 6 | 6 | 8 | 8 | 6 | 6 | 6 |
| 6 | 6 | 6 | 6 | 6 | 8 | 8 | 6 | 6 |
| 6 | 6 | 6 | 6 | 6 | 6 | 8 | 8 | 6 |
| 6 | 6 | 6 | 6 | 6 | 6 | 8 | 8 | 6 |
| 6 | 6 | 6 | 6 | 6 | 6 | 6 | 8 | 8 |

(b) Current Vth value

| | | | | | | | | |
|---|---|---|---|---|---|---|---|---|
| | | 1 | 1 | 1 | 1 | 1 | 1 | 1 |
| 1 | | | 1 | 1 | 1 | 1 | 1 | 1 |
| 1 | 1 | | | 1 | 1 | 1 | 1 | 1 |
| 1 | 1 | 1 | | | 1 | 1 | 1 | 1 |
| 1 | 1 | 1 | 1 | 3 | | 1 | 1 | 1 |
| 1 | 1 | 1 | 1 | 1 | | | 1 | 1 |
| 1 | 1 | 1 | 1 | 1 | 1 | | | 1 |
| 1 | 1 | 1 | 1 | 1 | 1 | | | 1 |
| 1 | 1 | 1 | 1 | 1 | 1 | 1 | | |

(c) Vth difference value

| | | | | | | | | |
|---|---|---|---|---|---|---|---|---|
| | | 0 | 0 | 0 | 0 | 0 | 0 | 0 |
| 0 | | | 0 | 0 | 0 | 0 | 0 | 0 |
| 0 | 0 | | | 0 | 0 | 0 | 0 | 0 |
| 0 | 0 | 0 | | | 0 | 0 | 0 | 0 |
| 0 | 0 | 0 | 0 | 2 | | 0 | 0 | 0 |
| 0 | 0 | 0 | 0 | 0 | | | 0 | 0 |
| 0 | 0 | 0 | 0 | 0 | 0 | | | 0 |
| 0 | 0 | 0 | 0 | 0 | 0 | | | 0 |
| 0 | 0 | 0 | 0 | 0 | 0 | 0 | | |

(d) Compensation value

DISPLAY DEVICE AND AFTERIMAGE COMPENSATION METHOD THEREOF

CROSS-REFERENCE TO RELATED APPLICATIONS

This application is the National Stage filing under 35 U.S.C. 371 of International Application No. PCT/KR2019/012379, filed on Sep. 24, 2019, the contents of which are all incorporated by reference herein in its entirety.

TECHNICAL FIELD

The present disclosure relates to a display device and an afterimage compensation method thereof and, more particularly, to a display device and an afterimage compensation method thereof, which are provided with an afterimage compensation function.

BACKGROUND ART

In general, an image display device displays images on a display panel such as a cathode ray tube, a liquid crystal panel, an electroluminescent panel, a light emitting diode panel, a plasma display panel, and the like.

Meanwhile, in a case of a panel such as an OLED image display device, when a still image is displayed for a long time, a light emitting device corresponding to the still image continuously emits light. When current flows continuously through a specific light emitting device for a long time, the corresponding light emitting device is overloaded, whereby the service lifespan of the corresponding light emitting device may be shortened. In addition, the color expression power of the corresponding light emitting device is lowered, so an afterimage of a previous image may remain in a current image, or a burn-in phenomenon in which a screen is not displayed clearly may occur.

In order to solve such a screen afterimage problem, an afterimage compensation method is used. It is common that afterimage compensation is performed sequentially from the uppermost end to the lowermost end of an entire screen at a predetermined period, but as the size of display panel increases, there is a problem that it takes a long time to perform the afterimage compensation.

DISCLOSURE

Technical Problem

An objective of the present disclosure is to provide a display device and an afterimage compensation method thereof that adaptively perform afterimage compensation according to edge intensity, brightness, or cumulative count for each pixel. Another objective of the present disclosure is to provide a display device and an afterimage compensation method thereof that periodically detect an edge in an image and establish data such as edge intensity and brightness for each pixel to individually perform afterimage compensation for each pixel. Yet another objective of the present disclosure is to provide a display device and an afterimage compensation method thereof that individually perform afterimage compensation for each pixel, thereby shortening the afterimage compensation time and performing the afterimage compensation only on an area requiring the afterimage compensation.

Technical Solution

In order to solve the above problems, a display device and an afterimage compensation method thereof according to an exemplary embodiment of the present disclosure includes: capturing an input image frame at a predetermined period; detecting an edge area in the captured image frame; detecting an afterimage compensation area on the basis of a cumulative count detected as the edge area for each pixel; and performing individual afterimage compensation only on a pixel whose cumulative count detected as the afterimage compensation area is greater than or equal to a predetermined threshold value.

The display device and the afterimage compensation method thereof according to the exemplary embodiment of the present disclosure may perform the afterimage compensation only on the pixel determined as an afterimage compensation target pixel when power of the display device is turned off.

In this case, an afterimage compensation value is determined by sensing a current threshold voltage of a block having a first size based on the afterimage compensation target pixel and comparing a threshold voltage of the afterimage compensation target pixel with respective threshold voltages of neighboring pixels of the block. The afterimage compensation value is determined by calculating, for each pixel, a difference value between the current threshold voltage and an initial threshold voltage of the block; and comparing a difference value of the threshold voltage of the afterimage compensation target pixel with respective difference values of the threshold voltages of the neighboring pixels belonging to the block.

The display device and the afterimage compensation method thereof according to the exemplary embodiment of the present disclosure may determine the afterimage compensation value of the afterimage compensation target pixel by comparing the difference value of the threshold voltage of the afterimage compensation target pixel with the respective difference values of the threshold voltages of the remaining pixels except for other afterimage compensation target pixels among the neighboring pixels belonging to the block, or except for pixels whose respective difference values of the threshold voltages have a deviation less than or equal to a predetermined size from the difference value of the threshold voltage of the afterimage compensation target pixel among the neighboring pixels belonging to the block.

The display device and the afterimage compensation method thereof according to the exemplary embodiment of the present disclosure may further perform the afterimage compensation additionally for pixels whose respective difference values of the threshold voltages have the deviation less than or equal to the predetermined size from the difference value of the threshold voltage of the afterimage compensation target pixel among the neighboring pixels belonging to a block having a second size based on the afterimage compensation target pixel.

In order to solve the problems as described above, a display device according to the exemplary embodiment of the present disclosure includes: an edge detection unit configured to capture an input image frame at a predetermined period and detect an edge area in the captured image frame; an afterimage compensation determining unit configured to detect the pixels detected as the edge area in a predetermined count or more by the edge detection unit as afterimage compensation areas, and determine, as an afterimage compensation target pixel, a pixel whose cumulative count detected as the afterimage compensation area is greater than or equal to a predetermined threshold value; and an afterimage compensation unit configured to perform the afterimage compensation on the afterimage compensation target pixel.

Advantageous Effects

As described above, the display device and the afterimage compensation method thereof according to the present disclosure individually perform afterimage compensation according to a condition for each pixel, whereby an afterimage compensation time may be shortened. In addition, the display device and the afterimage compensation method thereof individually perform afterimage compensation through edge detection on a pixel having a high probability of deterioration, whereby the service lifespan of display panel may be increased. In addition, since the display device and the afterimage compensation method thereof are not required to collectively perform afterimage compensation through the edge detection on a pixel having a low probability of deterioration, the efficiency of the afterimage compensation may be increased.

DESCRIPTION OF DRAWINGS

FIG. 4 is a view schematically illustrating an afterimage compensation method of an afterimage compensation unit according to the exemplary embodiment of the present disclosure.

MODE FOR INVENTION

Figure 1:
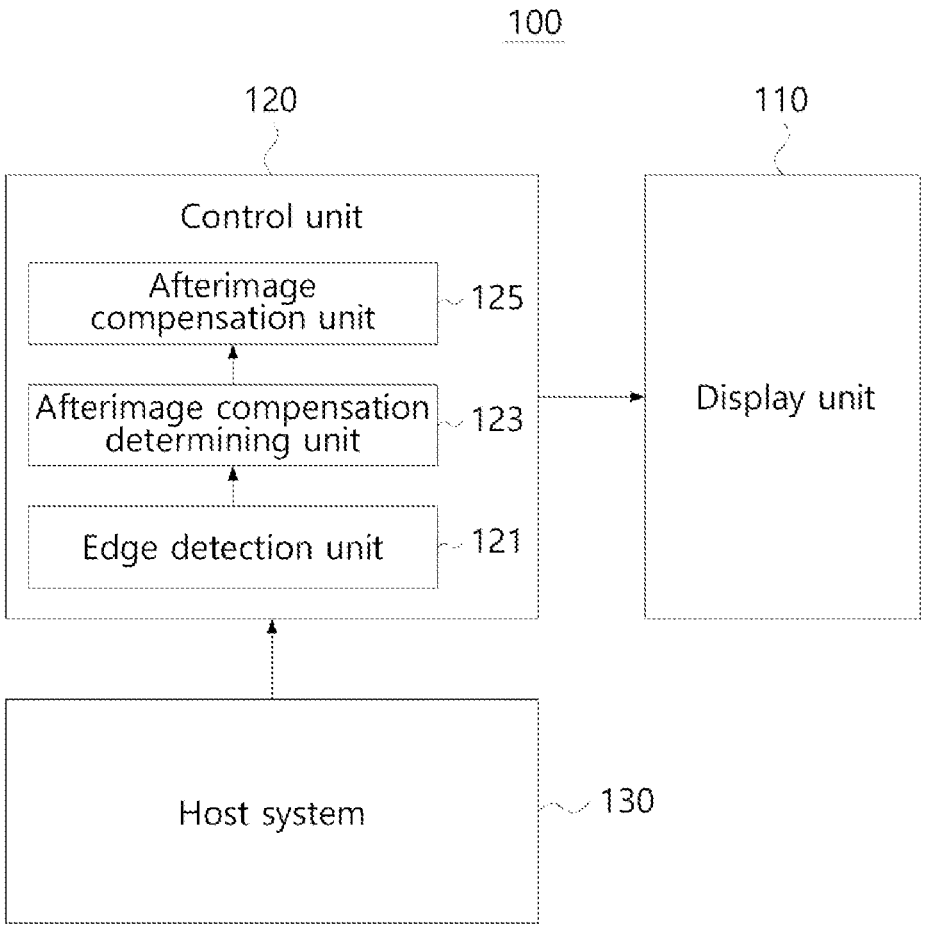
FIG. 1 is a control block diagram of a display device according to an exemplary embodiment of the present disclosure.

Hereinafter, specific exemplary embodiments of the present disclosure will be described with reference to the drawings.

Advantages and features of the present disclosure, and a method of achieving them will become apparent with reference to the exemplary embodiments described below in detail together with the accompanying drawings. However, the present disclosure is not limited to the exemplary embodiments disclosed below, but will be implemented in a variety of different forms. These exemplary embodiments are provided only to complete the disclosure of the present disclosure and to completely inform the scope of the present disclosure to those skilled in the art to which the present disclosure pertains, and the present disclosure is only defined by the scope of the claims. Like reference numerals generally denote like elements throughout the present disclosure.

FIG. 1 is a control block diagram of a display device 100 according to the exemplary embodiment of the present disclosure. Referring to FIG. 1, the display device 100 according to the exemplary embodiment of the present disclosure may be one of various electronic devices having a display means. For example, the display device 100 may include an electronic device such as a TV, a monitor, and a tablet PC, which are capable of receiving broadcasts.

Referring to FIG. 1, the display device 100 according to the exemplary embodiment of the present disclosure includes a display unit 110, a control unit 120, and a host system.

The display unit 110 is for displaying images, and is configured to include a display panel provided with pixels for displaying the images, a data driver 113 for driving data lines, and a gate driver 115 for driving gate lines. In the present exemplary embodiment, an example in which the display unit 110 is implemented by OLEDs will be described.

The control unit 120 receives various control signals related to power, image data, timing signals, and the like from the host system 130 to be described later, and controls the operation of the display unit 110 on the basis of the control signals. The control unit 120 captures an image input from the host system 130 to detect an edge, determines an afterimage compensation target pixel on the basis of edge intensity, brightness, and an edge cumulative count for each pixel, and performs the afterimage compensation for the afterimage compensation target pixel. The control unit 120 may be implemented by including: a memory in which an algorithm for detecting an edge, an algorithm for detecting an afterimage area, an algorithm for controlling a data table, and control codes are stored; and a processor that executes the control codes and the algorithms. In this case, the control unit 120 may be provided in a timing controller.

The host system 130 is for providing images to the display unit 110, and may be implemented by a TV, a navigation system, a set-top box, a DVD player, a Blu-ray player, a personal computer (PC), a home theater system, a broadcast receiver, a phone system, or the like. The host system may be implemented to constitute one display device 100 by being integrated with the above-described display unit 110 and the control unit 120. In the present exemplary embodiment, the host system 130, which is a TV having a broadcast reception function, includes a main system on chip (SoC) provided with a built-in decoder and scaler, and converts digital video data of the input images into a format suitable for display on a display panel, thereby outputting the digital video data to the control unit 120.

Referring to FIG. 1, the control unit 120 includes an edge detection unit 121, an afterimage compensation determining unit 123, and an afterimage compensation unit 125.

The edge detection unit 121 captures an input image frame at a predetermined period, and detects an edge area from the captured image frame. Here, a period for capturing an image and a period for detecting an edge may be determined to be in a range between 15 seconds and 45 seconds. When a value of brightness change between pixels for each area of an image frame is greater than or equal to a reference value, the edge detection unit 121 detects a corresponding pixel as an edge area. The edge detection unit may be implementable by at least any one of various algorithms applied with methods including: a method of using fixed-value masks of Roberts, Sobel, Friwitt, Laplacian, and the like; a morphological method of processing an image by approaching from a morphological point of view; and Canny edge detection method. For example, when brightness of a pixel differs by 35% or more to 45% or more compared to that of the surrounding pixels, the pixel may be detected as the edge area.

There is provided a memory (not shown) in which a data table related to edge areas is stored, and the data table related to edge areas stores edge intensity, image brightness (e.g., WRGB brightness), and edge cumulative count for each pixel coordinate. The edge detection unit 121 stores result values, for example, the edge intensity, image brightness, and edge cumulative count in the data table related to edge areas on the basis of the results of the edge area detection. In this case, the edge intensity and the image brightness refers to respective accumulated average values, and the edge cumulative count refers to a count consecutively accumulated as an edge. In a case where corresponding pixel is not consecutively detected as the edge area, the value of the corresponding edge cumulative count is reset. The embodiment of the present disclosure detects an edge area by capturing an image at a predetermined period, and when edge areas are consecutively detected, the detected edge area is determined as a still image area having high possibility of afterimage occurrence, that is, an area having high afterimage intensity that may cause afterimages, for example, an on-screen display (OSD) area or channel number display area, thereby performing edge accumulation counting. Whereas, when the edge areas are not consecutively detected, it is determined that there is low possibility of afterimage occurrence, thereby resetting the edge accumulation counting.

The afterimage compensation determining unit 123 detects, as an afterimage compensation area, a pixel consecutively detected as the edge area for a predetermined count or more by the edge detection unit 121, and determines, as an afterimage compensation target pixel, a pixel whose cumulative count detected as the afterimage compensation area is greater than or equal to a predetermined threshold value. There is provided the memory (not shown) in which a data table related to afterimage compensation areas is stored, and the data table related to afterimage compensation areas stores edge intensity, image brightness (e.g., WRGB brightness), and afterimage compensation cumulative count for each pixel.

In the case of a pixel whose edge cumulative count consecutively detected as the edge area in the data table related to edge areas is greater than or equal to a first threshold value, for example, n times or more, the afterimage compensation determining unit 123 detects the pixel as an afterimage compensation area, and updates, in the data table related to afterimage compensation areas, the edge intensity, image brightness (e.g., WRGB brightness), and afterimage compensation area cumulative count at the coordinates of the corresponding pixel.

For example, when edge cumulative count in the data table related to edge areas is 20 or more, the afterimage compensation determining unit 123 detects a corresponding pixel as an afterimage compensation area, turns on an afterimage compensation area flag, and updates, in the data table related to afterimage compensation areas, the afterimage compensation area value corresponding to the relevant pixel coordinate. In a case where an edge detection period is 30 seconds, the edge cumulative count of 20 is meant to be equal to 30*20=600 seconds, that is, 10 minutes, and when a still image having the same edge in a corresponding area is displayed for the 10 minutes, the area is determined as an afterimage compensation area.

In this case, in the data table related to afterimage compensation areas, the afterimage compensation determining unit 123 stores the accumulated average values of edge intensity and image brightness of the corresponding pixel, and stores the afterimage area cumulative count by accumulating an afterimage area counting number. For example, when the edge cumulative count of a pixel at coordinates (200, 199) is counted as 20, the afterimage compensation determining unit 123 adds 1 to the afterimage compensation area cumulative count at coordinates (200, 199) in the data table related to afterimage compensation areas, and resets the edge cumulative count in the data table related to edge areas.

The afterimage compensation determining unit 123 determines a pixel whose afterimage area cumulative count is greater than or equal to a second threshold value, for example, m times or more, as an afterimage compensation target pixel. Here, the number m may be determined in consideration of the afterimage characteristics of the display unit 110. For example, when a threshold time determined to cause a problem in the characteristics of display deterioration due to edges is time A, the second threshold value may be determined in consideration of the time A. For example, in a case where the value of time A is 300 hours, since an accumulated value of the afterimage compensation area becomes 1 when a pixel is detected an edge area for 10 minutes in the above-described example, a number 1,800 corresponding to 300 hours may be determined as the second threshold value.

In another exemplary embodiment, the afterimage compensation determining unit 123 may take a value of the edge cumulative count as it is and accumulate the value as the afterimage compensation area cumulative count as well. For example, when the edge cumulative count is 20, the calculation may be performed by adding 20 to the afterimage compensation area cumulative count as it is. In this case, since the accumulated value of the afterimage compensation area increases by 20 each time it is counted once as an afterimage compensation area, the second threshold value corresponding to 300 hours may be determined to be 36,000. The second threshold value may be determined differently according to edge intensity and characteristics of the display unit 110. The afterimage compensation determining unit 123 turns on an afterimage compensation enable flag for the pixel determined as an afterimage compensation target pixel.

The afterimage compensation unit 125 performs afterimage compensation on a pixel determined as an afterimage compensation target pixel by the afterimage compensation determining unit 123 and whose afterimage compensation enable flag is turned on. When the power of the display device 100 is turned off, the afterimage compensation unit 125 performs the afterimage compensation on the pixel whose afterimage compensation enable flag is turned on.

Figure 2:
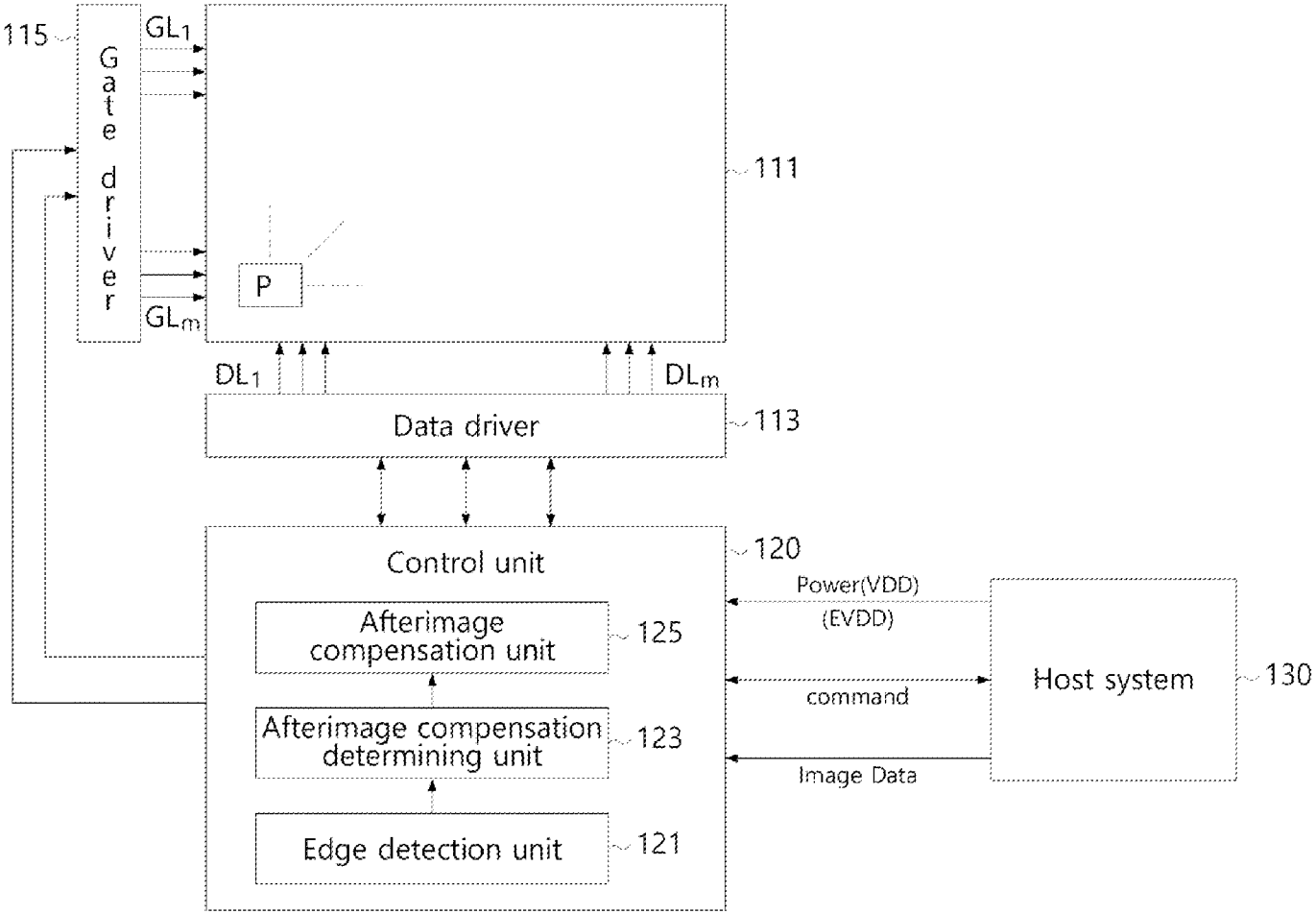
FIG. 2 is a detailed block diagram of the display device according to the exemplary embodiment of the present disclosure.
Figure 3:
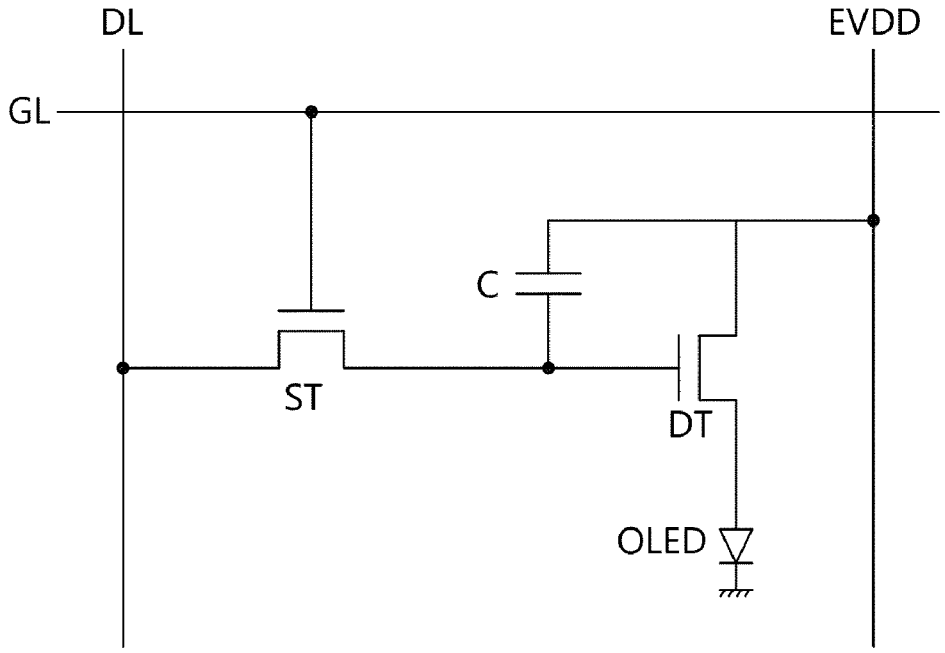
FIG. 3 is a view illustrating an example of a sub-pixel of a display panel according to the exemplary embodiment of the present disclosure.

The operation of the afterimage compensation unit 125 will be described in detail with reference to FIGS. 2 and 3. FIG. 2 is a detailed block diagram of the display device 100 according to the exemplary embodiment of the present disclosure, and FIG. 3 is a view illustrating an example of a sub-pixel of a display panel. A description that overlaps with the above-described exemplary embodiment will be omitted.

Referring to FIG. 2, the display unit 110 includes a display panel, a gate driver 115, and a data driver 113. The display panel 111 includes: a plurality of data lines DL and a plurality of gate lines GL, which are disposed in a direction of intersecting with each other; a plurality of pixels P disposed therein in a matrix type; and a plurality of power lines disposed to apply a driving voltage to a plurality of sub-pixels (SP). Each of the plurality of sub-pixels (SP) disposed in the matrix type is configured to include an OLED, a driving transistor, a switch transistor, a capacitor, and the like. One pixel includes the plurality of sub-pixels (SP), including a red sub-pixel, a green sub-pixel, and a blue sub-pixel, or including a white sub-pixel, a red sub-pixel, a green sub-pixel, and a blue sub-pixel. Each sub-pixel (SP)

may have one or more different light-emitting areas according to light-emitting characteristics thereof.

The data driver 113 supplies data voltages to the plurality of data lines DL1 to DLm and drives the plurality of data lines DL1 to DLm. The gate driver 115 sequentially supplies scan signals to the plurality of gate lines GL1 to GLn and sequentially drives the plurality of gate lines GL1 to GLn.

Referring to FIG. 3, each sub-pixel (SP) includes: an organic light emitting diode (OLED); a driving transistor DT for controlling driving by way of switching power supply to the OLED; a switch transistor ST for switching an electrical connection between the data line DL and a gate of the driving transistor DT by switching control from the signal of the gate line GL; and a capacitor C having one end thereof connected to a junction node of a source of the driving transistor DT and having the other end thereof connected to respective junction nodes of the gate of the driving transistor DT and a drain of the switch transistor ST.

The control unit 120 receives inputs of various control signals related to power, image data, timing signals, and the like from the host system 130, and controls the operations of the data driver 113 and the gate driver 115 on the basis of the inputs. The control unit 120 starts scanning according to a timing implemented in each frame, converts image data input from the host system 130 to be suitable to a data signal format used by the data driver 113, outputs the converted image data, and controls driving of the data according to the scanning. The gate driver 115 sequentially supplies scan signals of the on-voltage or the off-voltage to the plurality of gate lines GL1 to GLn under the control of the control unit 120, and sequentially drives the plurality of gate lines GL1 to GLn.

As described above, the edge detection unit 121 detects an edge in an image frame input from the host system 130, and updates the data table related to edge areas according to the detected result. The afterimage compensation determining unit 123 updates the data table related to afterimage compensation areas on the basis of the data table related to edge areas, and determines an afterimage compensation target pixel, thereby turning on the afterimage compensation enable flag for the afterimage compensation target pixel.

Conventionally, afterimage compensation is performed on all pixels, but according to the present disclosure, afterimage compensation is selectively performed on an afterimage compensation target pixel. Centered on an afterimage compensation target pixel whose afterimage compensation enable flag is turned on in the afterimage compensation determining unit 123, the afterimage compensation unit 125 performs scanning only a block area having a first size as a reference, senses current threshold voltages of the driving transistors of the corresponding pixels, and determines an afterimage compensation value of the afterimage compensation target pixel by comparing a difference value between a threshold voltage of the afterimage compensation target pixel and respective threshold voltages of the neighboring pixels belonging to the block.

The afterimage compensation unit 125 scans only the block area having the first size with the current afterimage compensation target pixel as a center, and stores the sensed value of the threshold voltage Vth of the driving transistor of the corresponding pixel in the memory. A sensing circuit for sensing the threshold voltage Vth of each pixel is provided separately, and the data current supplied to an OLED by using the sensing circuit may be sensed by using an analog to digital converter (ADC) of the data driver 113. In addition, an initial threshold voltage Vth of the driving transistor of each pixel is stored in the memory as a data table. The initial threshold voltage Vth is a threshold voltage Vth of each pixel before deterioration, and the afterimage compensation unit 125 compares the currently sensed threshold voltage with an initial threshold voltage in the data table to determine a deterioration and compensation value.

FIG. 4 is a view schematically illustrating an afterimage compensation method of the afterimage compensation unit 125 according to the exemplary embodiment of the present disclosure. Referring to FIG. 4, the afterimage compensation unit 125 determines an afterimage compensation value on the basis of threshold voltages of neighboring pixels of a block having the first size, for example, a size of 9*9, centered on an afterimage compensation target pixel (e.g., each hatched pixel in FIG. 4). FIG. 4(*a*) is a view illustrating initial threshold voltage values of the block having the size of 9*9, centered on the afterimage compensation target pixel, and FIG. 4(*b*) is a view illustrating an example of currently sensed threshold voltage values of the corresponding block. In FIG. 4(*a*), the pixels of the corresponding block all have the same initial threshold voltage of 5, but it may be confirmed that the currently sensed threshold voltage values are different in FIG. 4(*b*). The pixels indicated by bold edges in FIGS. 4(*b*) to 4(*d*) refer to pixels determined as afterimage compensation target pixels. For the corresponding afterimage compensation target pixels, the afterimage compensation values are determined respectively on the basis of threshold voltages of neighboring pixels of each block having the size of 9*9, based on the corresponding afterimage compensation target pixel.

The afterimage compensation unit 125 calculates a difference value between a current threshold voltage and an initial threshold voltage for each pixel in a corresponding block. Here, the difference value between the current threshold voltage and the initial threshold voltage means a degree of deterioration for each pixel. FIG. 4(*c*) illustrates the difference value of the threshold voltage for each pixel, and it may be confirmed that the difference value between the current threshold voltage and the initial threshold voltage is 3 for the current afterimage compensation target pixel, and is 1 for each surrounding pixel. When determining an afterimage compensation value of the afterimage compensation target pixel, the afterimage compensation unit 125 according to the exemplary embodiment of the present disclosure may determine the afterimage compensation value by considering only the threshold voltages of the remaining pixels except for other afterimage compensation target pixels belonging to the corresponding block. In the present disclosure, by excluding the threshold voltages of other afterimage compensation target pixels when performing afterimage compensation, the compensation values may be appropriately determined on the basis of pixels that are not edge areas.

Meanwhile, according to another exemplary embodiment, when determining an afterimage compensation value, the afterimage compensation unit 125 may exclude not only other afterimage compensation target pixels, but also pixels whose respective difference values between current threshold voltages and initial threshold voltages have a deviation less than or equal to a predetermined size from a difference value of the current afterimage compensation target pixel. For example, the afterimage compensation unit 125 may exclude pixels whose respective difference values are 90% or more of a corresponding difference value based on the difference value (i.e., deterioration value) between the current threshold voltage and the initial threshold voltage of the current afterimage compensation target pixel, and determine the afterimage compensation value on the basis of the remaining pixels. For example, when the difference value between the threshold voltage and the initial threshold voltage of the current afterimage compensation target pixel is 3, the afterimage compensation value may be determined by considering only the threshold voltage difference values of the remaining pixels except for pixels whose threshold voltage difference value is 2.7 or more.

The afterimage compensation unit 125 may determine the afterimage compensation value of the current afterimage compensation target pixel by subtracting an average of the difference values of the threshold voltages of the remaining pixels from the difference value of the threshold voltage of the current afterimage compensation target pixel. FIG. 4(*d*) illustrates the afterimage compensation value calculated for the current afterimage compensation target pixel. Since the difference value between the threshold voltage of the current afterimage compensation target pixel is 3 and the average of the difference values of the threshold voltages of the remaining pixels is 1, the afterimage compensation value of the current afterimage compensation target pixel is determined to be 2. The afterimage compensation unit 125 compensates a data voltage supplied to the corresponding pixel according to the determined afterimage compensation value. The afterimage compensation unit 125 performs the above-described afterimage compensation value calculation and afterimage compensation for the remaining afterimage compensation target pixels as well.

According to another exemplary embodiment of the present disclosure, the afterimage compensation unit 125 may perform afterimage compensation on pixels whose respective threshold voltage difference values have a deviation less than or equal to a predetermined size from the threshold voltage difference value of a corresponding afterimage compensation target pixel among neighboring pixels belonging to a block having a second size based on the current afterimage compensation target pixel other than the pixels determined as the afterimage compensation target pixels. In this way, in addition to the pixel determined as the afterimage compensation target pixel, on pixels that are deteriorated in the vicinity thereof, the afterimage compensation may be performed as well. For example, on the basis of the difference value (i.e., deterioration value) between the current threshold voltage and the initial threshold voltage of a current afterimage compensation target pixel in a block area of 5*5 size centered on the current afterimage compensation target pixel, the above-described afterimage compensation may be performed by additionally determining pixels having respective difference values that is 90% or more of the corresponding difference value as afterimage compensation target pixels.

Hereinafter, the methods of determining an afterimage compensation target area and compensating for afterimages according to the exemplary embodiment of the present disclosure will be described with reference to FIGS. 5 and 6.

Figure 5:
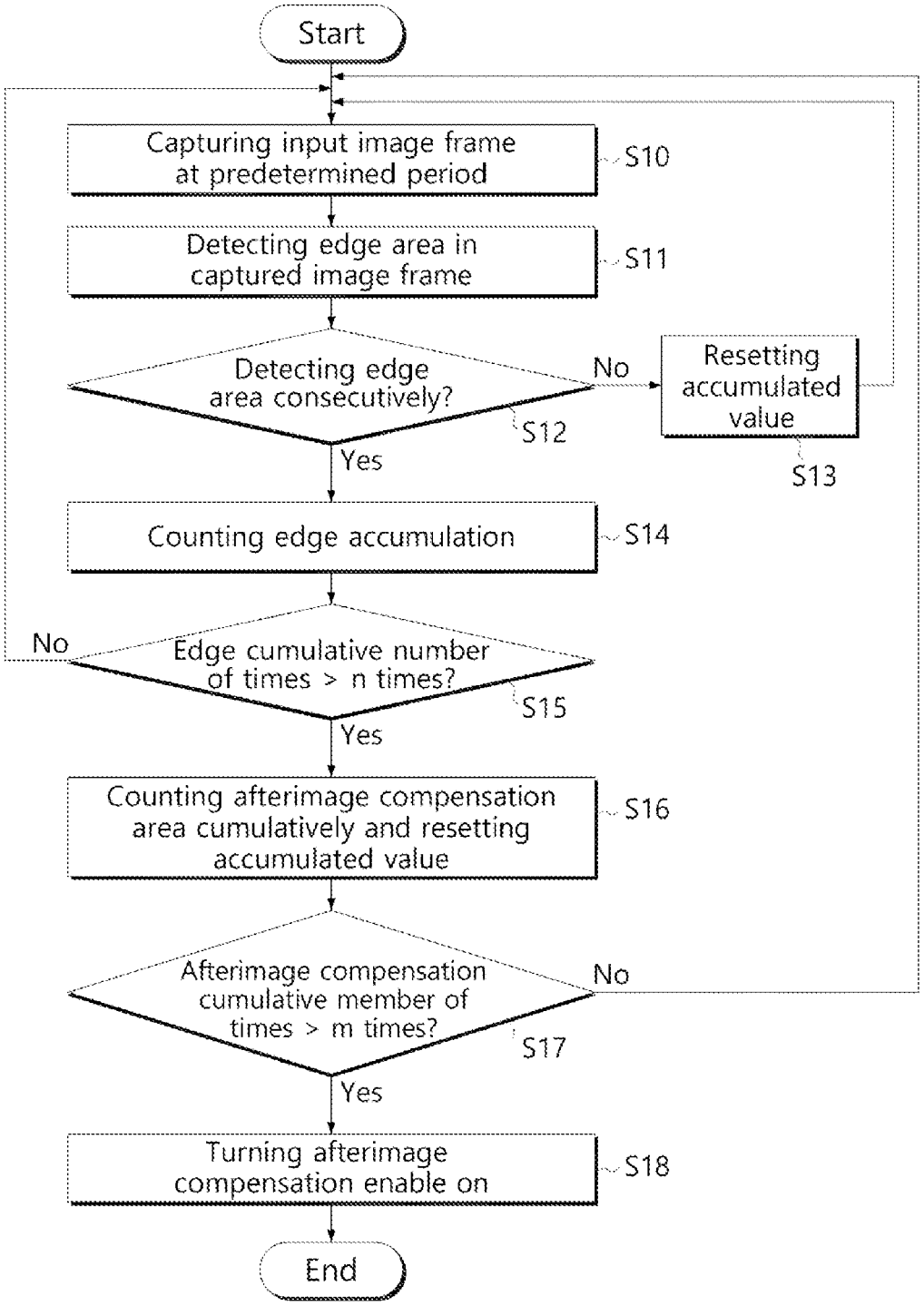
FIG. 5 is a flowchart illustrating a method of determining an afterimage compensation target area of the display device according to the exemplary embodiment of the present disclosure.

FIG. 5 is a flowchart illustrating the method of determining an afterimage compensation target area of the display device 100 according to the exemplary embodiment of the present disclosure. Referring to FIG. 5, first, in step S10, an image frame input from the host system 130 is captured at a predetermined period. In addition, in step S11, an edge area is detected from the captured image frame. As described above, the edge area detection may be performed by various edge detection algorithms. In the present disclosure, an edge detection technique suitable for detecting a still image area, for example, an OSD area or the like, which is prone to deterioration, may be used.

In step S12, for pixels detected as edge areas, whether each pixel is consecutively detected as the edge area is checked. In step S14, In a case where a corresponding pixel is detected as the edge area in an immediately preceding frame, since the edge area is consecutively detected, the data table related to edge areas is updated by counting the edge accumulation value. In addition, average values of values such as brightness and edge intensity of each pixel, in addition to the edge accumulation value, are calculated and updated in the data table related to edge areas for each pixel. In this case, in step S13, when the pixel is not consecutively detected as the edge area, the edge accumulated value is reset. For example, in a case where on the basis of the current frame, a specific pixel is detected as the edge area three consecutive times and the edge accumulation value becomes '3', when the pixel is not detected as the edge area in this captured image frame, the edge accumulation value is reset and becomes '0'. Meanwhile, in step S12, the edge accumulated value may be updated to '1' by performing edge accumulation counting without checking whether the pixel having the edge accumulation value of '0' is consecutively detected. As another example, an embodiment may be implemented such that a separate flag is provided to be able to check whether an edge is detected in an immediately preceding captured image frame, a corresponding flag value is changed to 'on' when a pixel having an edge accumulation value of '0' is detected as the first edge area, and the corresponding flag is read and the accumulated counting is performed when checking whether or not edge counts are accumulated in the next capture frame.

In step S16, when a pixel is consecutively detected as the edge area in the count greater than or equal to a first threshold value n, for example, 20 or more times, and an edge accumulation value becomes 20, the afterimage compensation determining unit 123 cumulatively counts the afterimage compensation area value of the corresponding pixel. In addition, the edge accumulation value is reset. Accordingly, the afterimage compensation area value is cumulatively counted every time the corresponding pixel is detected as the edge area in 20 consecutive times.

In a case where the afterimage compensation area cumulative count is greater than or equal to a second threshold value m in step S17, an afterimage compensation target pixel is determined, and an afterimage compensation enable flag is turned on for the afterimage compensation target pixel in step S18. Accordingly, the afterimage compensation unit 125 performs afterimage compensation on the pixel whose afterimage compensation enable flag is turned on.

Figure 6:
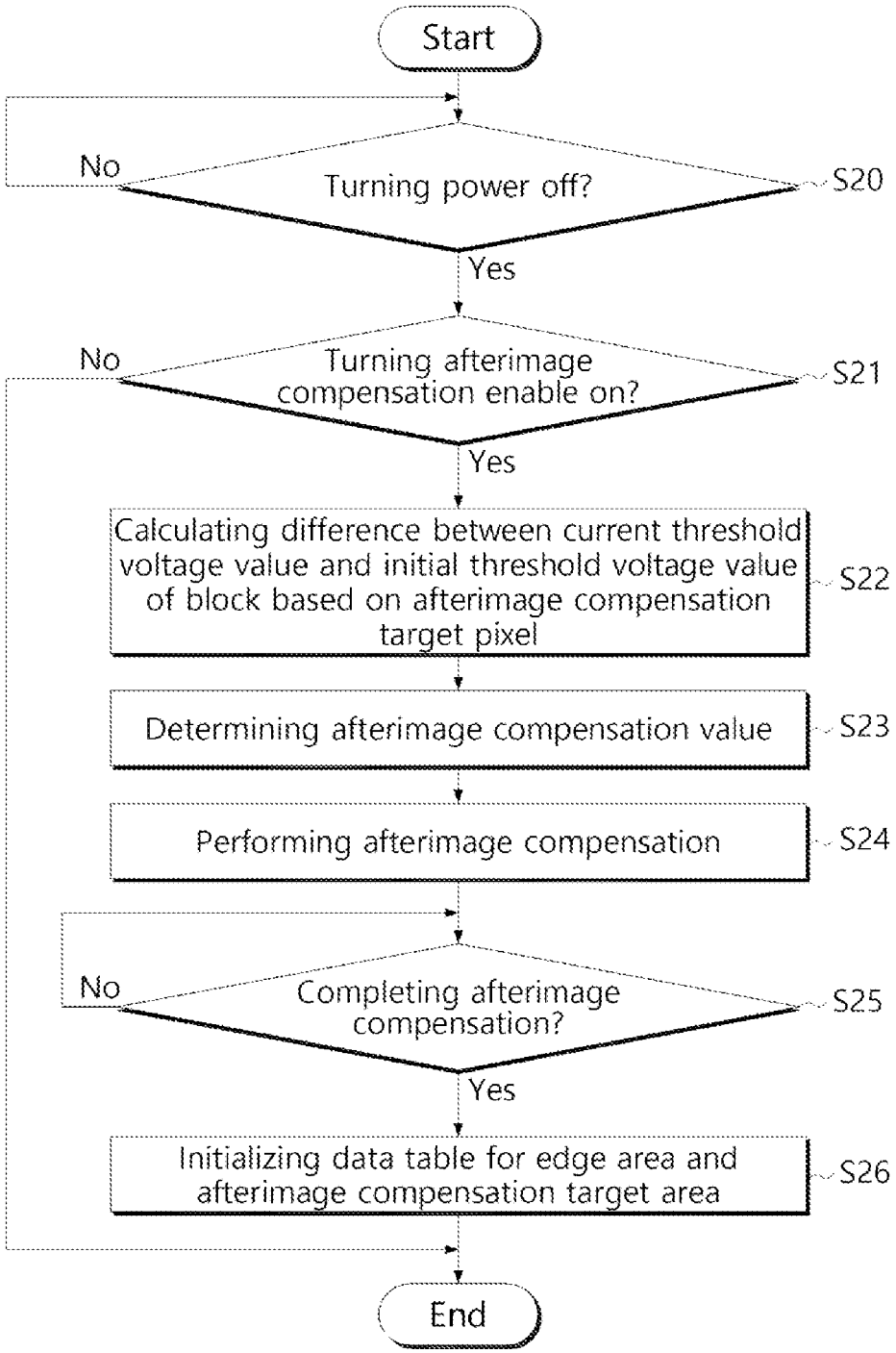
FIG. 6 is a flowchart illustrating the afterimage compensation method of the display device according to the exemplary embodiment of the present disclosure.

FIG. 6 is a flowchart illustrating the afterimage compensation method of the display device 100 according to the exemplary embodiment of the present disclosure. In step S20, the afterimage compensation unit 125 performs afterimage compensation when the power of the display device 100 is turned off. In general, in the case of OLED, three execution modes may be sequentially performed, the modes including: an OFF-RS mode, a cooling mode, and an afterimage compensation mode. In FIG. 6, it is assumed that the OFF-RS mode and the cooling mode are performed after the display device 100 is powered off, and accordingly only a method of performing the afterimage compensation mode will be described. Conventionally, when a display panel usage time exceeds a predetermined time, afterimage compensation is performed on all pixels, but in the present disclosure, the afterimage compensation is performed only for pixels determined as afterimage compensation target pixels and whose respective afterimage compensation enable flag are turned on. That is, the afterimage compensation is performed only on the pixel that is determined as an afterimage compensation target pixel because the cumulative count detected as the afterimage compensation area is greater than or equal to the second threshold value.

In step S21, when there is a pixel whose afterimage compensation enable flag is turned on, the afterimage compensation is performed on the corresponding pixel after the OFF-RS and cooling time has elapsed. The threshold voltage values of the driving transistors of the pixels are sensed by scanning a block area of a first size centered on an afterimage compensation target pixel, and an afterimage compensation value of the afterimage compensation target pixel is determined by comparing the threshold voltage of the afterimage compensation target pixel with respective threshold voltages of neighboring pixels belonging to the block. For example, in step S22, a difference value, that is, a deterioration value, is calculated by comparing the currently sensed threshold voltage value and a pre-stored initial threshold voltage value.

In addition, in step S23, the afterimage compensation value of the afterimage compensation target pixel is determined by comparing the difference value of the threshold voltage of the current afterimage compensation target pixel with respective difference values of the threshold voltages of neighboring pixels belonging to the block. In this case, the afterimage compensation value of the current afterimage compensation target pixel may be determined on the basis of only the respective difference values of the threshold voltages of the remaining pixels except for other afterimage compensation target pixels among the neighboring pixels belonging to the block. This is to prevent distortion of the afterimage compensation value due to the deterioration value of the same afterimage compensation target pixel.

In step S25, when the afterimage compensation value is determined for the current afterimage compensation target pixel, the data voltage supplied to the corresponding pixel is compensated. The afterimage compensation unit 125 performs calculation for the above-described afterimage compensation value and afterimage compensation for the remaining afterimage compensation target pixels. In addition, in step S26, for the pixel whose afterimage compensation has been completed, the corresponding data table related to edge areas and the corresponding data table for afterimage compensation target areas are initialized, and the afterimage compensation enable flag is turned off.

In the above-described exemplary embodiment, it has been described that the edge detection unit 121 and the afterimage compensation determining unit 123 determine the afterimage compensation target pixel on the basis of the cumulative count of consecutive edge area detection, but further, it is natural that the afterimage compensation target pixel may be determined by additionally considering the edge intensity, that is, a change in brightness difference with respective neighboring pixels. In addition, in the above-described exemplary embodiment, it has been described that the edge detection unit 121 and the afterimage compensation determining unit 123 are included in the control unit 120 (e.g., timing controller) on the display panel side to be implemented, but according to another exemplary embodiment, the edge detection unit 121 and the afterimage compensation determining unit 123 may be implemented by a main SoC of the host system 130. For example, the main SoC detects an edge area by capturing, at an output terminal, an image processed by an image processing module such as the decoder and the scaler of the host system 130 and finally output the edge area to the control unit 120 on the display panel side, and detects an afterimage compensation area and an afterimage compensation target pixel, thereby finally providing data related to the afterimage compensation target pixel to the control unit 120 on the display panel side. The afterimage compensation unit 125 provided in the control unit 120 on the display panel side may perform afterimage compensation on the basis of the data related to the afterimage compensation target pixel, the data being input from the main SoC of the host system 130. In addition, although it has been described that the display unit 110 includes OLEDs in the above-described exemplary embodiment as an example, it is natural that all displays on which afterimages are generated may be applicable.

Meanwhile, the method of operating the display device 100 of the present disclosure may be implemented as processor-readable codes on a processor-readable recording medium provided in the display device 100. The processor-readable recording medium includes all types of recording devices in which data readable by the processor is stored. Examples of the processor-readable recording medium include ROM, RAM, CD-ROM, magnetic tape, floppy disks, optical data storage devices, and the like, and also includes those implemented in the form of carrier waves such as transmission over the Internet. In addition, the processor-readable recording medium is distributed in a computer system connected to a network, so that the processor-readable code may be stored and executed in a distributed method.

In addition, in the above, the preferred exemplary embodiments of the present disclosure have been illustrated and described, but the present disclosure is not limited to the specific exemplary embodiments described above. In the present disclosure, various modifications may be possible by those skilled in the art to which the present disclosure belongs without departing from the spirit of the present disclosure claimed in the claims, and these modifications should not be understood individually from the technical ideas or prospect of the present disclosure.

The invention claimed is:

1. An afterimage compensation method of a display device, the method comprising:

capturing an input image frame at a predetermined period;

detecting an edge area in the captured image frame;

detecting an afterimage compensation area on the basis of a cumulative count detected as the edge area for each pixel; and performing afterimage compensation on a pixel whose cumulative count detected as the afterimage compensation area is greater than or equal to a predetermined threshold value.

2. The method of claim 1, wherein the detecting of the afterimage compensation area comprises:

counting the number of times that each pixel is consecutively detected as a same edge area; and detecting, as the afterimage compensation area, a pixel whose count consecutively detected as the edge area is greater than or equal to a first threshold value.

3. The method of claim 2, wherein the performing of the afterimage compensation comprises:

checking whether there is the pixel whose cumulative count detected as the afterimage compensation area is greater than or equal to a second threshold when power of the display device is turned off; and performing the afterimage compensation on an afterimage compensation target pixel whose cumulative count is greater than or equal to the second threshold value.

4. The method of claim 3, wherein the performing of the afterimage compensation on the afterimage compensation target pixel comprises:

sensing a current threshold voltage of a block having a first size based on the afterimage compensation target pixel; and determining an afterimage compensation value of the afterimage compensation target pixel by comparing a threshold voltage of the afterimage compensation target pixel with respective threshold voltages of neighboring pixels of the block.

5. The method of claim 4, wherein the determining of the afterimage compensation value of the afterimage compensation target pixel comprises:

calculating, for each pixel, a difference value between the current threshold voltage and an initial threshold voltage of the block; and determining the afterimage compensation value of the afterimage compensation target pixel by comparing a difference value of the threshold voltage of the afterimage compensation target pixel with respective difference values of the threshold voltages of the neighboring pixels belonging to the block.

6. The method of claim 5, wherein the determining of the afterimage compensation value of the afterimage compensation target pixel determines the afterimage compensation value of the afterimage compensation target pixel by comparing the difference value of the threshold voltage of the afterimage compensation target pixel with the respective difference values of the threshold voltages of the remaining pixels except for other afterimage compensation target pixels among the neighboring pixels belonging to the block.

7. The method of claim 5, wherein the determining of the afterimage compensation value of the afterimage compensation target pixel determines the afterimage compensation value of the afterimage compensation target pixel by comparing the difference value of the threshold voltage of the afterimage compensation target pixel with the respective difference values of the threshold voltages of the remaining pixels except for pixels whose respective difference values of the threshold voltages have a deviation less than or equal to a predetermined size from the difference value of the threshold voltage of the afterimage compensation target pixel among the neighboring pixels belonging to the block.

8. The method of claim 7, further comprising:

performing the afterimage compensation for pixels whose respective difference values of the threshold voltages have the deviation less than or equal to the predetermined size from the difference value of the threshold voltage of the afterimage compensation target pixel among the neighboring pixels belonging to a block having a second size based on the afterimage compensation target pixel.

9. The method of claim 1, wherein the detecting of the edge area detects the edge area when a brightness change value between pixels for each area of the image frame is greater than or equal to a reference value.

10. A display device, comprising:

a display unit provided with pixels for displaying an image;

an edge detection unit configured to capture an input image frame at a predetermined period and detect an edge area in the captured image frame;

an afterimage compensation determining unit configured to detect the pixels detected as the edge area in a predetermined count or more by the edge detection unit as afterimage compensation areas, and determine, as an afterimage compensation target pixel, a pixel whose cumulative count detected as the afterimage compensation area is greater than or equal to a predetermined threshold value; and an afterimage compensation unit configured to perform the afterimage compensation on the afterimage compensation target pixel.

11. The display device of claim 10, wherein the afterimage compensation determining unit counts the number of times that each pixel is consecutively detected as the same edge area, detects, as the afterimage compensation area, a pixel whose count consecutively detected as the edge area is greater than or equal to a first threshold value, and determines, as the afterimage compensation target pixel, a pixel whose cumulative count detected as the afterimage compensation area is greater than or equal to a second threshold value.

12. The display device of claim 11, further comprising:

a control unit configured to control a data driver and a gate driver, wherein the display unit comprises:

a display panel comprising a plurality of data lines and a plurality of gate lines disposed therein, a plurality of pixels disposed therein in matrix type, and a plurality of power lines disposed to apply a driving voltage to the plurality of pixels;

the data driver configured to drive each data line; and the gate driver configured to drive each gate line, each pixel comprises:

an organic light-emitting diodes; and a driving transistor configured to control driving by switching power supply to the organic light-emitting diode, and the edge detection unit, the afterimage compensation determining unit, and the afterimage compensation unit are provided in the control unit.

13. The display device of claim 12, wherein the afterimage compensation unit senses current threshold voltages of the driving transistors of pixels belonging to a block having a first size based on the afterimage compensation target pixel in the display panel, calculates a difference value between a current threshold voltage and an initial threshold voltage for each pixel, and determines an afterimage compensation value of the afterimage compensation target pixel by comparing a difference value of the threshold voltage of the afterimage compensation target pixel and respective difference values of the threshold voltages of neighboring pixels belonging to the block.

14. The display device of claim 13, wherein the afterimage compensation unit determines the afterimage compensation value of the afterimage compensation target pixel by comparing the difference value of the threshold voltage of the afterimage compensation target pixel with the difference values of the threshold voltages of the remaining pixels except for other afterimage compensation target pixels or pixels whose respective difference values of threshold voltages have a deviation less than or equal to a predetermined size from the difference value of the threshold voltage of the afterimage compensation target pixel among the neighboring pixels belonging to the block.

15. The display device of claim 14, wherein the afterimage compensation unit performs the afterimage compensation on pixels whose respective difference values of the threshold voltages have the deviation less than or equal to the predetermined size from the threshold voltage difference value of the afterimage compensation target pixel among neighboring pixels belonging to a block having a second size based on the afterimage compensation target pixel.

16. The display device of claim 15, wherein the edge detection unit detects the edge area when a brightness change value between pixels for each area of the image frame is greater than or equal to a reference value.

17. The display device of claim 13, wherein the afterimage compensation unit performs the afterimage compensation on pixels whose respective difference values of the threshold voltages have the deviation less than or equal to the predetermined size from the threshold voltage difference value of the afterimage compensation target pixel among neighboring pixels belonging to a block having a second size based on the afterimage compensation target pixel.

18. The display device of claim 17, wherein the edge detection unit detects the edge area when a brightness change value between pixels for each area of the image frame is greater than or equal to a reference value.

19. The display device of claim 12, wherein the afterimage compensation unit performs the afterimage compensation on pixels whose respective difference values of the threshold voltages have the deviation less than or equal to the predetermined size from the threshold voltage difference value of the afterimage compensation target pixel among neighboring pixels belonging to a block having a second size based on the afterimage compensation target pixel.

20. The display device of claim 19, wherein the edge detection unit detects the edge area when a brightness change value between pixels for each area of the image frame is greater than or equal to a reference value.

* * * * *